United States Patent [19]

Hammer et al.

[11] 4,104,815

[45] Aug. 8, 1978

[54] STEAM IRON

[75] Inventors: Urs Hammer, Oberbuchsiten; Ernst Gisiger, Niederbuchsiten, both of Switzerland

[73] Assignee: Jura Elektroapparate-Fabriken L. Henzirohs A.G., Niederbuchsiten, Switzerland

[21] Appl. No.: 850,734

[22] Filed: Nov. 11, 1977

[30] Foreign Application Priority Data

Nov. 19, 1976 [CH] Switzerland ..... 14596/76

[51] Int. Cl.[2] ..... D06F 75/18

[52] U.S. Cl. ..... 38/77.5; 38/88; 38/90

[58] Field of Search ..... 38/74, 77.1, 77.5, 77.7, 38/77.8, 79, 88, 89, 90

[56] References Cited

U.S. PATENT DOCUMENTS 3,626,615 12/1971 Zuccarello ..... 38/77.8

FOREIGN PATENT DOCUMENTS 258,847 12/1967 Austria.
1,159,897 9/1959 Fed. Rep. of Germany.
2,442,126 3/1975 Fed. Rep. of Germany ..... 38/77.5
1,050,601 12/1976 United Kingdom.

*Primary Examiner*—Henry S. Jaudon
*Attorney, Agent, or Firm*—Zarley, McKee, Thomte, Voorhees & Sease

[57] ABSTRACT

A steam iron comprising a one-piece component accommodating two bores usable as pump cylinders and a cover making it possible either to seal off one or both cylinder bores or to leave both open at the top. The cylinders may then be used selectively in conjunction with associated pistons and ducts to supply water to either a spray nozzle, a delivery spout for introducing additional water into a vaporization chamber, or both. The one-piece component may also provide the possibility of selectively sealing or leaving open certain valve bores associated with the pump cylinders.

5 Claims, 3 Drawing Figures

STEAM IRON

This invention relates to steam irons of the type having a water reservoir, a vaporization chamber, a handle, and two cylinders disposed in the portion of the handle situated nearest the front of the iron and including respective bottom portions situated nearest the water reservoir and respective top openings situated remote from the water reservoir.

Steam irons of the aforementioned type are already known. In such irons, the cylinders are parts of pump units forming a separate component secured either to the housing or to the front of the handle of the iron.

Furthermore, the two cylinders are equipped with upwardly projecting cylinder heads, to each of which a displaceable pump rod is attached.

There are two decisive drawbacks associated with these previously known steam irons. For one thing, the design of the two cylinders as a component to be assembled with the other parts of the handle is complicated as concerns assembly and comparatively expensive as concerns manufacturing costs. Moreover, because of the protruding cylinder heads, there is no possibility of selectively equipping a steam iron with just a front spray nozzle or just a device for supplying additional water, or even dispensing with both.

It is an object of this invention to provide an improved steam iron of the type in question which is much simpler to assemble, less expensive, and designed for being equipped with two, one, or even no pump units, as may be desired.

To this end, in the steam iron according to the present invention, the improvement comprises a one-piece component including the cylinders and at least parts of the handle, and a cover element having two segments capable of being either selectively broken out of the cover element or of selectively sealing off the respective top openings of the two cylinders.

Figure 1:
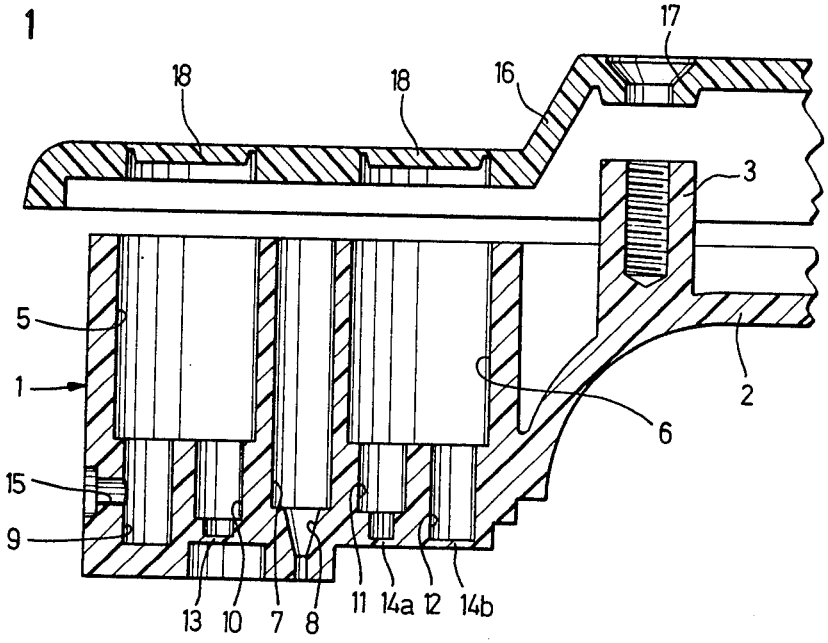
Figure 2:
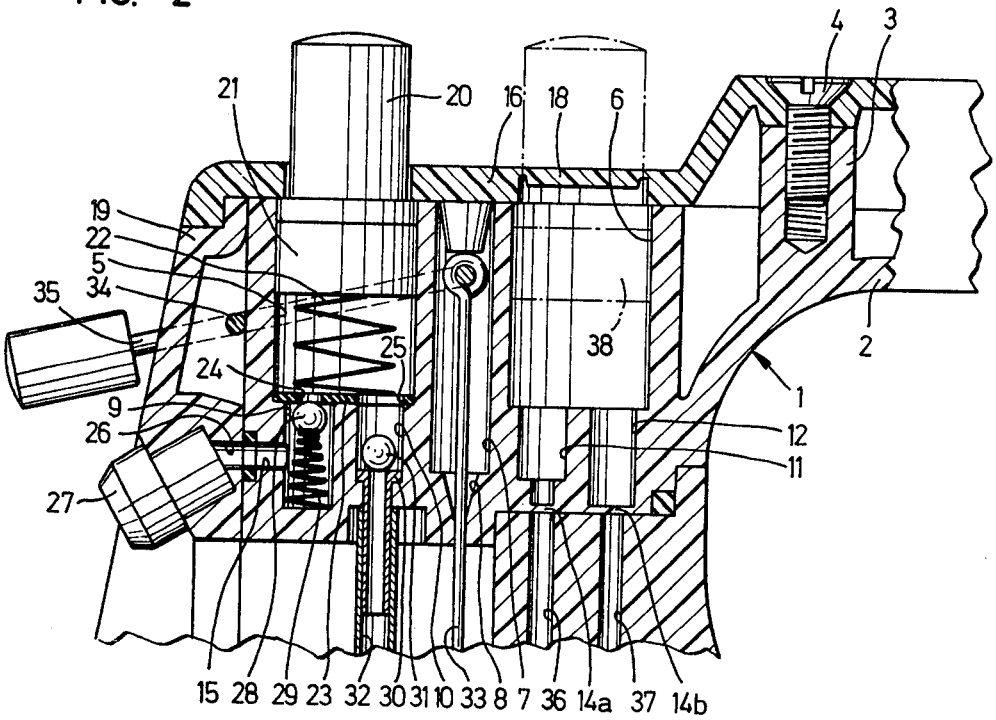
Figure 3:
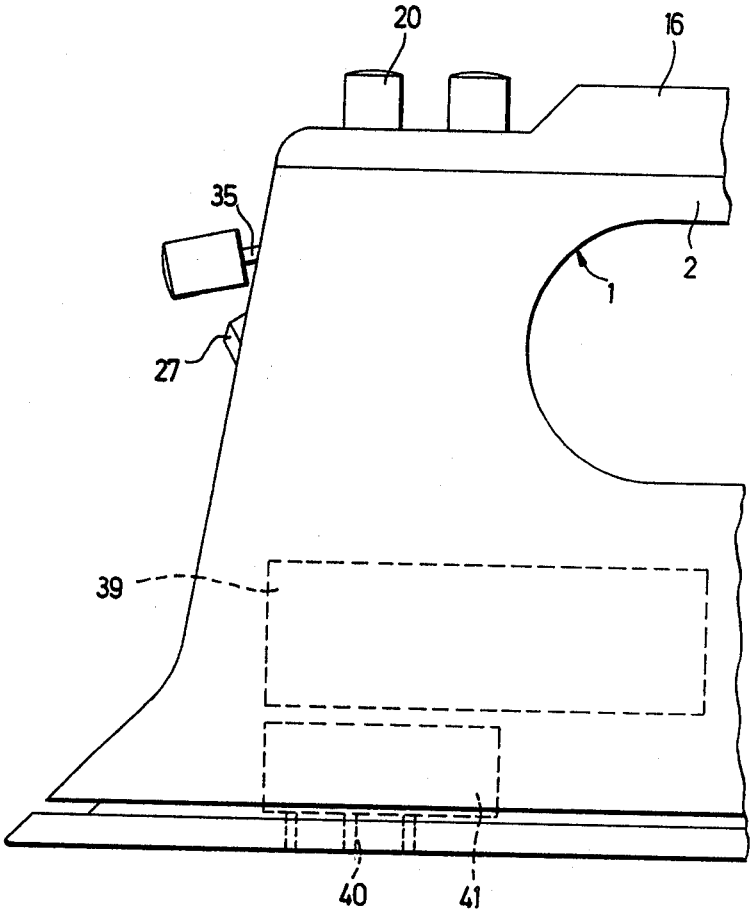

A preferred embodiment of the invention will now be described in detail with reference to the accompanying drawings, in which:

FIG. 1 is a section through the front bottom portion of the steam iron handle and the one-piece component comprising the two cylinders, and through the cover element, FIG. 2 is a corresponding section through the upper front part of the steam iron, omitting one of the pump units, and FIG. 3 is a diagrammatic view of the front part of the steam iron.

As may be seen in FIG. 1, a moulded one-piece component 1, preferably made of plastics, comprises the lower portion 2 of a handle, an upwardly projecting element 3 for receiving the shank of a connecting screw 4, and, towards the front, two cylinders 5 and 6 as well as a recess 7 which is situated between the cylinders 5 and 6 and is contiguous with a conical guide portion 8. The cylinders 5 and 6 continue downwardly into two pairs of valve bores 9, 10 and 11, 12, respectively, of smaller diameter The bottom openings of the three valve bores 10, 11, and 12 are respectively covered by three diaphragms 13, 14*a*, and 14*b* which form part of the component 1 and are capable of being broken out of that component by pressure. The frontmost valve bore 9 communicates with an outlet channel 15 running at a right angle to the longitudinal axis of the bore 9.

The component 1 is closed off at the top by a cover 16 which is likewise moulded in one piece. Besides a recess 17 for the head of the connecting screw 4, the cover 16 includes two segments 18 which are capable of being broken out of the cover by pressure. When the cover 16 and the component 1 are joined, the segments 18 come to lie over the top openings of the cylinders 5 and 6.

FIG. 2 shows the upper front part of the steam iron with the cover 16 joined to the component 1 by the screw 4, simultaneously incorporating a front plate 19. The frontmost segment 18 has been broken out of the cover 16, and through the aperture thus formed there passes an operating button 20 of a piston 21 disposed in the cylinder 5. The piston 21 is supported by a return spring 22 resting upon a base plate 23 which includes two apertures 24 and 25 respectively communicating with the valve bores 9 and 10. Disposed within the frontmost valve bore 9, which communicates via the outlet channel 15 and a bore 26 in the front plate 19 with a spray nozzle 27, is a ball valve 28 which is sealingly pressed against the aperture 24 by a spring 29. In the case of the adjacent valve bore 10, the bottom diaphragm 13 has been broken out of the component 1 to permit the insertion of a valve part 30, upon the orifice of which a further ball valve 31 is seated by its own weight. Slipped over the other end of the valve part 30 is a supply duct 32 leading to a water reservoir 39 (FIG. 3) of the steam iron.

It will be easily understood that when the piston 21 is caused up move up and down within the cylinder 5 by means of the operating button 20 and the spring 22, water is first drawn from the reservoir 39 through the supply duct 32 and the valve 30/31 into the cylinder 5, then ejected through the spray nozzle 27 via the aperture 24, the channel 15, and the bore 26 upon the downward movement of the piston 21.

The recess 7 accommodates a valve stem 33 for a nozzle (not shown) situated between the water reservoir 39 and a vaporizing chamber 41 (FIG. 3). The valve stem 33 can be caused to move up and down by pivoting a lever 35 about a fulcrum 34, and by means of this movement of the valve stem 33, deposits of scale can be scraped off the inside of the aforementioned nozzle.

In the embodiment illustrated, the rear cylinder 6 is shown as unused in FIGS. 1 and 2. As may be seen from FIG. 3, however, after the segment 18 associated with the cylinder 6 and the diphragms 14*a* and 14*b* have been broken out, the cylinder 6 may accommodate a piston 38, identical with and corresponding to the piston 21, and the valve bores 11 and 12 will communicate with ducts 36 and 37 respectively leading to the water reservoir 39 and to a delivery spout 40 for introducing additional water into the vaporization chamber 41. Upon operation of the piston 38, the entire pump unit thus formed draws water from the reservoir 39 and causes it to be sprayed out through the delivery spout 40 in the vaporization chamber 41.

One of the advantages made possible by the arrangement described is the extremly simple assembly of the two cylinders 5 and 6, one of which is intended to form part of a pump unit for spraying water out of the nozzle 27, while the other pump unit, of which the cylinder 6 forms part, is intended to supply additional water to the vaporization chamber 41. Furthermore, the design described provides the possibility of equipping the steam iron with either one or the other or both of these pump units, or even of dispensing with both of them, without necessitating any complicated steps.

In addition, the cylinders which are not used to form a pump unit are also covered at the bottom by the diaphragms 13 and 14*a*, 14*b*, so that the associated cylinders are sealed off from the water reservoir 39, and neither water nor steam can enter these unused cylinders.

What is claimed is:

1. In a steam iron of the type having a water reservoir, a vaporization chamber, a handle, and two cylinders disposed in the portion of said handle situated nearest the front of said iron and including respective bottom portions situated nearest said water reservoir and respective top openings situated remote from said water reservoir, the improvement comprising:

a one-piece component including said cylinders and at least parts of said handle and a cover element having two segments capable of being either selectively broken out of said cover element or of selectively sealing off said respective top openings of said two cylinders.

2. A steam iron in accordance with claim 1, further comprising a piston disposed within one of said cylinders to form a pump unit having an inlet side and a delivery side, a duct connecting said inlet side to said water reservoir, and a forwardly directed spray nozzle connected to said delivery side.

3. A steam iron in accordance with claim 1, further comprising a piston disposed within one of said cylinders to form a pump unit having an inlet side and a delivery side, a duct connecting said inlet side to said water reservoir, and a delivery spout disposed in said vaporization chamber for supplying additional water and connected to said delivery side.

4. A steam iron in accordance with claim 1, further comprising two pistons respectively disposed within each of said cylinders to form two pump units each having an inlet side and a delivery side, two ducts respectively connecting each said inlet side to said water reservoir, a forwardly directed spray nozzle connected to said delivery side of one of said pump units, and a delivery spout disposed in said vaporization chamber for supplying additional water and connected to said delivery side of the other of said pump units.

5. A steam iron in accordance with claim 1, further comprising two pairs of valve bores each respectively associated with one of said two cylinders and disposed adjacent to said bottom portions thereof, the geometrical longitudinal axes of said cylinders and of said valve bores all being parallel to one another and at least three of said valve bores having respective bottom openings situated remote from said cylinders, said one-piece component further including at least three diaphragm portions capable of being either selectively broken out of said one-piece component or of selectively sealing off said respective bottom openings of said least three valve bores.

* * * * *